United States Patent [19]

Ichikawa

[11] 4,401,864

[45] Aug. 30, 1983

[54] SEESAW TYPE SWITCH MECHANISM

[75] Inventor: Hiroki Ichikawa, Hachioji, Japan

[73] Assignee: Olympus Optical Company Ltd., Tokyo, Japan

[21] Appl. No.: 268,908

[22] Filed: Jun. 1, 1981

[30] Foreign Application Priority Data

| | | | |
|---|---|---|---|
| Jul. 10, 1980 | [JP] | Japan | 55-97106[U] |
| Jul. 10, 1980 | [JP] | Japan | 55-97107[U] |
| Jul. 10, 1980 | [JP] | Japan | 55-97108[U] |
| Jul. 10, 1980 | [JP] | Japan | 55-97109[U] |
| Jul. 10, 1980 | [JP] | Japan | 55-97110[U] |

[51] Int. Cl.[3] ..... H01H 3/00; H01H 13/00

[52] U.S. Cl. ..... 200/17 R; 200/6 B; 200/153 K; 200/339

[58] Field of Search ..... 200/1 R, 1 B, 5 R, 5 B, 200/5 C, 6 A, 6 B-6 C, 17 R, 18, 153 K, 339

[56] References Cited

U.S. PATENT DOCUMENTS

| | | | |
|---|---|---|---|
| 2,813,160 | 11/1957 | Tong | 200/5 C |
| 3,254,191 | 5/1966 | Reiner | 200/339 |
| 4,045,650 | 8/1977 | Nestor | 200/339 X |
| 4,103,126 | 7/1978 | DeNigris et al. | 200/339 X |
| 4,117,280 | 9/1978 | Feaster | 200/339 X |
| 4,124,787 | 11/1978 | Aamoth et al. | 200/17 R X |
| 4,209,674 | 6/1980 | Kondo | 200/339 X |
| 4,256,931 | 3/1971 | Palisek | 200/153 K X |

FOREIGN PATENT DOCUMENTS

| | | | |
|---|---|---|---|
| 1389212 | 1/1965 | France | 200/153 K |
| 1259356 | 1/1972 | United Kingdom | 200/339 |

OTHER PUBLICATIONS

Japanese Published Examined Utility Model Application; Publication No. sho 51-11933; Application No. Sho 49-3417.

*Primary Examiner*—J. R. Scott

*Attorney, Agent, or Firm*—Weinstein & Sutton

[57] ABSTRACT

A switch mechanism comprises an operating member having an outer surface including tabs formed on the left- and the right-hand half thereof, with switch operating protuberances formed on the rear surface thereof in alignment with the respective tabs. A recess is integrally formed in a housing of an electrical instrument, and the operating member is rockably disposed in the recess for seesaw motion therein. A pair of pushbutton switches are disposed on paths of movement of the protuberances, and are quickly operated by an angular movement of the operating member through a reduced angular stroke.

28 Claims, 27 Drawing Figures

SEESAW TYPE SWITCH MECHANISM

BACKGROUND OF THE INVENTION

The invention relates to a seesaw type switch mechanism, and more particularly, to a switch mechanism of the type in which a switching operation occurs in response to an operating pushbutton which undergoes a seesaw motion.

A seesaw type switch of the prior art includes an operating pushbutton having a front surface including a left-hand and a right-hand half which are formed with tabs to receive a finger for angularly moving the pushbutton either clockwise or counter-clockwise about an axis extending through an arm which is formed on the rear surface of the pushbutton for driving a slider of a sliding switch. By rocking the pushbutton either clockwise or counter-clockwise, the slider is displaced to operate the sliding switch.

With a conventional construction as mentioned above, it is necessary that the slider exhibits an increased stroke for its sliding movement. This requires that the arm on the pushbutton has an increased length from the axis to its free end which engages the slider and that the pushbutton be rocked through an increased angle. These requirements result in an increased size of the construction. Additionally, a pair of return springs having a relatively high resilience are required to return the combination of the slider and pushbutton to their original positions. Furthermore, it is necessary to provide a click stop mechanism for normally maintaining the pushbutton at its neutral position. It will thus be seen that the resulting construction is complex, and requires a cumbersome assembly.

When such seesaw type switch is mounted on a housing of an electrical instrument, the seesaw motion of the pushbutton results in the right-hand half of the pushbutton projecting out of the front surface of the housing of the electrical instrument when the left-hand half of the pushbutton is depressed. Such projection detracts from the appearance of the instrument. Hence it is desirable that an outstanding projection of the pushbutton outwardly from the front surface of the housing of the instrument be avoided during the operation of the pushbutton.

SUMMARY OF THE INVENTION

It is a first object of the invention to provide a seesaw type switch mechanism having a pair of switch operating protuberances formed on the rear surface of an operating member which undergoes a seesaw motion, thus allowing a switch operation to be achieved.

It is a second object of the invention to provide a switch mechanism including an operating member which is constructed such that whenever a tab formed on the left-hand half of the front surface thereof is operated, the member rocks about a fulcrum defined by an edge of the right-hand half while whenever a tab formed on the right-hand half of the front surface is operated, the member rocks about a fulcrum defined by the edge of the left-hand half, thus avoiding a projection of the member to the exterior of the mechanism.

In accordance with the invention, a protuberance is centrally formed on the rear surface of the operating member and merely functions as a fulcrum to allow a rocking motion of the switch mechanism. A switching operation takes place by a pair of tabs located on the opposite sides of the central protuberance. A pushbutton switch is associated with each of the tabs, and hence the angle through which the operating member rocks can be reduced, thus allowing the switch mechanism to be formed as a compact construction. In other words, the seesaw type switch mechanism of the invention achieves a switching operation with a stroke which is no more than the stroke employed with a pushbutton switch which is well known in itself. A reduced number of parts used facilitates the assembly.

Since the switching operation takes place in accordance with the invention by a rocking motion about a fulcrum defined by one or the other of the edges of the operating member, projection of the operating member to the exterior is avoided, thus eliminating the likelihood that such projection may degrade the appearance of an associated electrical instrument.

DESCRIPTION OF PREFERRED EMBODIMENTS

Figure 1:
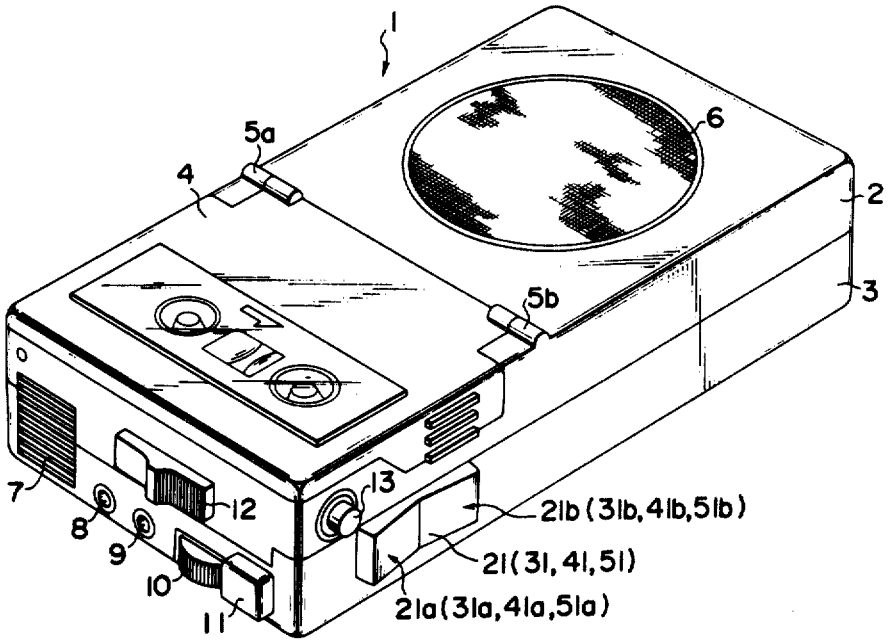
FIG. 1 is a perspective view of a miniature size tape recorder to which the seesaw type switch mechanism of the invention is applied.

Referring to FIG. 1, there is shown a miniature size tape recorder 1 which is representative of an electrical instrument in which the seesaw type switch mechanism of the invention may be assembled. The tape recorder 1 employs a micro-cassette which is sized on the order of a small packet of matches. The tape recorder 1 is rectangular in outer profile, defined by an upper housing 2 and a lower housing 3. One-half of the upper surface of housing 2 is covered by a closure member 4 which is hinged at 5a, 5b to the remainder of the housing 2 in which an opening associated with a loudspeaker is formed with a network 6 thereacross. The closure member 4 can be freely opened and closed to confine a tape cassette receiving chamber of the tape recorder. The housing includes a front face in which a grille 7 associated with an internally housed microphone, a jack 8 for receiving an external microphone, an earphone jack 9, a volume control 10, a pause button 11 and a power switch 12 are disposed. While not shown, the left-hand side face of the housing is provided with a number of buttons which may be used to establish a record mode, a playback mode and a stop mode. An eject button 13 is disposed in the right-hand side face of the housing for ejecting a tape cassette from the cassette receiving chamber.

A seesaw type switch mechanism of the invention is assembled into the housing in a manner such that its operating member 21 has its outer surface exposed through the right-hand side face of the tape recorder 1, for example. The front surface of the operating member 21 is defined by a pair of left- and right-hand tabs 21a, 21b. When the tab 21a is depressed or pushed inward into the housing, a switch member 16 (see FIG. 2) mounted on a substrate (see FIG. 2) 15 located within the housing is operated to establish a rapid advance mode, for example. Alternatively, the tab 21b may be depressed to operate a switch member 17 (see FIG. 2), similarly mounted on the substrate 15, to establish a tape rewind mode, for example.

The housings 2, 3 are formed of an electrically insulating material such as plastics, and the seesaw type switch mechanism of the invention is disposed within the lower housing 3 so as to be distributed along the boundary between the housings 2 and 3.

Figure 2:
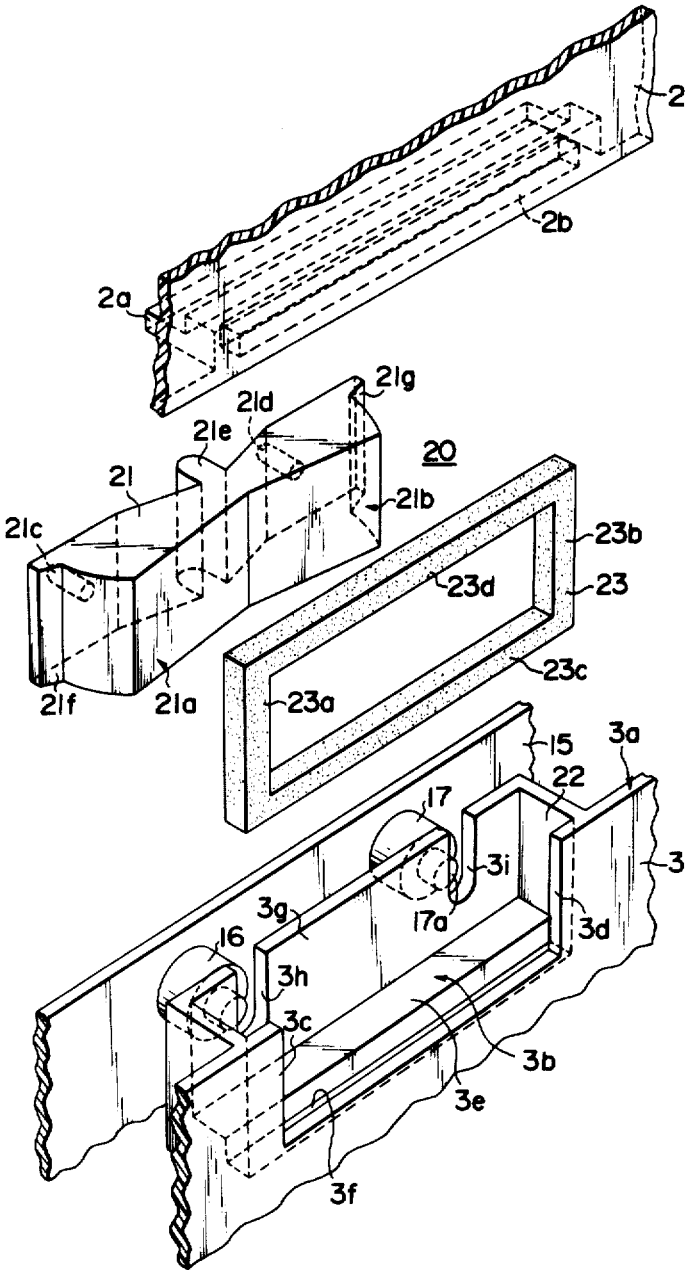
FIG. 2 is an exploded perspective view of a seesaw type switch mechanism according to a first embodiment of the invention.

FIG. 2 is an exploded perspective view of a seesaw type switch mechanism according to a first embodiment of the invention. The switch mechanism 20 essentially comprises an operating member 21 which undergoes a seesaw motion, a recess 22 in which the operating member 21 is rockably received, a pair of switch members 16, 17 which are acted upon by the operating member 21, and a return member 23 for returning the operating member 21 to its original, inoperative position.

The operating member 21 is a rocking member and has a generally rectangular configuration having a relatively large thickness which is formed of an electrically insulating material such as a plastic material. On its front surface which is exposed though the housing, it is provided with a pair of tabs 21a, 21b located in the left-hand and right-hand half thereof for angularly moving the operating member 21 in different directions. The tabs 21a, 21b have their surfaces defined by oppositely inclined surfaces which join at the longitudinal center of the operating member where it is most depressed. A pair of protuberances 21c, 21d for operating switch members 16, 17 are integrally formed on the rear surface of the operating member 21 in alignment with the tabs 21a, 21b while another protuberance 21e defining a fulcrum for the rocking motion of the operating member is integrally mounted centrally on the rear surface. The protuberance 21e is in the form of a transversely extending rib. The rib 21e has a semicircular shaped free end so that its abutment against the inner wall of the recess 22 defines a fulcrum for the rocking motion of the operating member 21. It will be noted that the short sides of the operating member 21 are formed with outwardly extending ledges 21f, 21g in an integral manner, which operate to bear against the return member 23 whenever the operating member 21 is angularly driven.

The return member 23 is in the form of transversely elongate frame which fits around the periphery of the operating member 21 and is formed of an elastic foamed plastic material such as urethane foam. When the operating member 21 is angularly driven, one of short sides 23a, 23b is compressed by one of the ledges 21f, 21g.

The recess 22 is formed in the lower housing 3 and is box-shaped having a size which is sufficient to contain the operating member 21 in a rockable manner along a boundary surface 3a between the housings 2,3. The box configuration of the recess 22 is open in its top and in its front side, and is contiguous with the sidewall of the lower housing 3. Located on the opposite sides of the front opening 3b are sidewalls 3c, 3d of a reduced length which extend in the plane of the opening 3b for constraining the location of the operating member 23, thus preventing an outward dislocation of the return member 23. Along its bottom, the inner surface of the sidewalls 3c, 3d is formed with a transverse groove 3f for allowing the bottom 23c of the return member 23 to fall onto the bottom wall 3e of the recess 22. The inner wall 3g of the recess 22 is formed with notches 3h, 3i at locations on paths of angular movement of the protuberances 21c, 21d formed on the operating member 21 and which are open in their top end. A substrate 15 on which parts are fixedly mounted within the housing is located behind the inner wall 3g, and carries the switch members 16, 17 thereon which are disposed in alignment with notches 3h, 3i. The switch members 16, 17 are in the form of pushbutton switches having pushbuttons 16a, 17a (see FIGS. 4 and 5) which may be depressed inward by the protuberances 21c, 21d, respectively, to open or close their associated electrical contacts.

On the other hand, the upper housing 2 is integrally formed with a closure plate 2a extending into the housing and located in alignment with the open top of the recess 22. Toward the front edge, the closure plate 2a is formed with a transverse groove 2b which fits around the upper side 23d of the return member 23. The purpose of the closure plate 2a is to cover the open top of the recess 22 when the upper and lower housing 2, 3 mate with each other.

Figure 3:
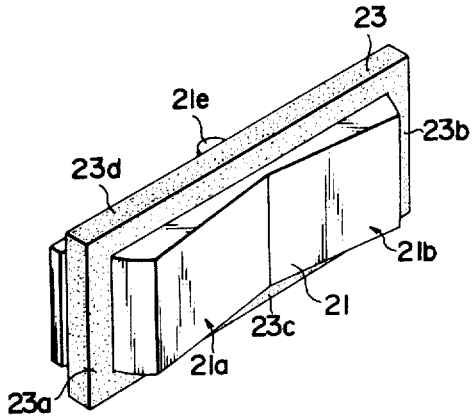
FIG. 3 is a perspective view illustrating the engaged condition of the operating member and return member, both shown in FIG. 2.
Figure 4:
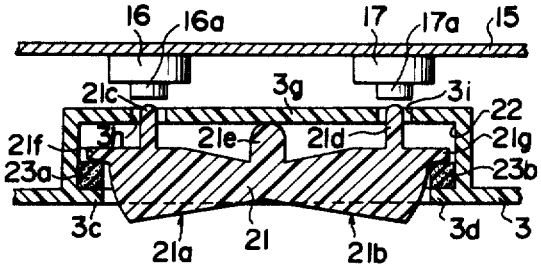
FIG. 4 is a cross section of the seesaw type switch mechanism shown in FIG. 2.

When assembling the switch mechanism of the present embodiment into the housing, the frame-shaped return member 23 is fitted around the operating member 21 as indicated in FIG. 3, and the assembly is placed into the recess 22 through the open top thereof. Thereupon, the bottom side 23c of the return member 23 engages the transverse groove 3f formed in the recess 22, whereby the outer surface of the short sides 23a, 23b bear against the inner surface of the short side walls 3c, 3d, which partly define the recess 22, while the short sides 23a, 23b each have their rear surface placed in abutment against the outer portions of the ledges 21f, 21g of the operating member 21, as shown in FIG. 4. As a result, the protuberance 21e formed centrally on the rear surface of the operating member 21 abuts against the inner surface of the inner wall 3g of the recess while the protuberances 21c, 21d extend into the notches 3h, 3i. It will be noted that the tabs 21a, 21b of the operating member 21 are received in the recess 22 in a manner such that they are equally exposed through the front opening 3b by projecting therethrough.

When both the operating member 21 and the return member 23 are received in the recess 22, the upper housing 2 may be brought into mating relationship with the lower housing 3, whereupon the closure plate 2a formed on the upper housing 2 closes the open top of the recess 22 to prevent an ingress of any dust while the transverse groove 2b fits around the upper side 23d of the return member 23, thus preventing the latter against an unintended movement.

Figure 5:
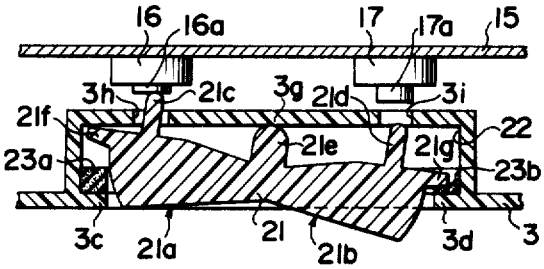
FIG. 5 is a cross section illustrating an operating condition of the seesaw type switch mechanism shown in FIG. 2.

Referring to FIG. 5, the operation of the switch mechanism assembled into the housing in the manner mentioned will now be described. When the left-hand tab 21a is depressed, the operating member 21 moves clockwise about a fulcrum which is defined by the abutment of the protuberance 21e against the inner wall 3g. The switch operating protuberance 21c associated with the tab 21a presses against the pushbutton 16a of the switch member 16, thereby operating the electrical contact thereof. As the operating member 21 moves clockwise, the right-hand ledge 21g compresses the right-hand short side 23b of the return member 23 against its resilience. In this manner, a restoring resilience is stored in the short side 23b. When the tab 21a is released, the restoring resilience moves against the ledge 21g to cause the operating member 21 to move counter-clockwise about the fulcrum, thus returning it to the original positon shown in FIG. 4.

Alternatively, when the right-hand tab 21b is depressed, the operating member 21 moves counter-clockwise about the fulcrum, with the right-hand switch operating tab 21b operating the switch member 17. Simultaneously, the left-hand ledge 21f compresses the left-hand short side 23a of the return member 23, thus storing a restoring resilience. When the tab 21b is released, the operating member 21 moves clockwise about the fulcrum under the restoring resilience supplied by the short side 23a, thus returning to the original position. It will be appreciated from the above description that in the switch mechanism of the present embodiment, the return member 23 functions to provide a balanced positioning of the operating member 21 within the recess 22.

Figure 6:
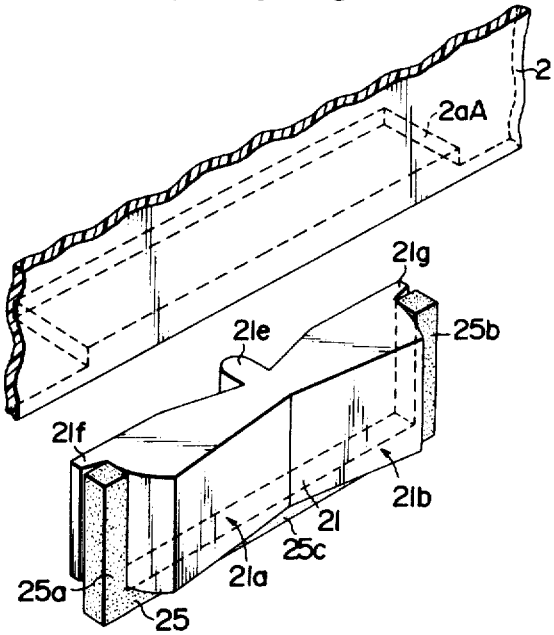
FIG. 6 is a perspective view of another form of return member.

In the embodiment shown in FIGS. 2 to 5, the return member 23 is formed as a rectangular frame. Alternatively, as indicated in FIG. 6, the upper side of the frame may be removed, thus providing a return member 25 which comprises a bottom side 25c and a pair of lateral, short sides 25a, 25b. In this instance, a closure plate 2aA formed on the upper housing 2 need not be formed with a transverse groove as in the previous embodiment.

Figure 7:
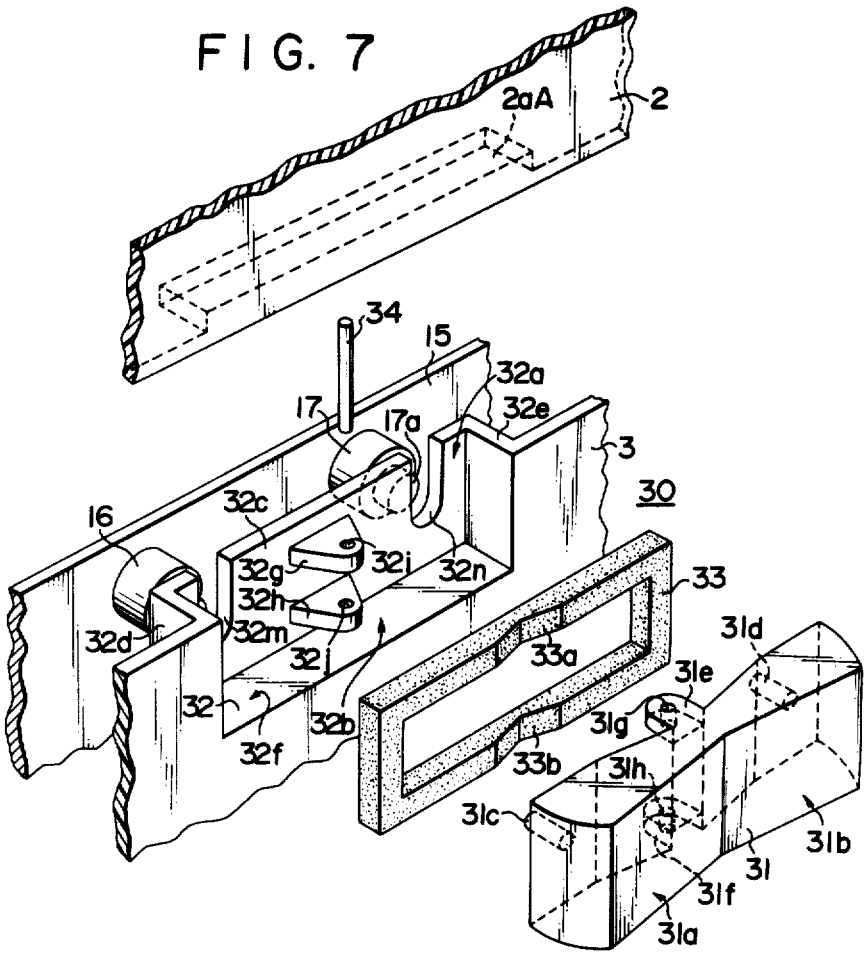
FIG. 7 is an exploded perspective view of a seesaw type switch mechanism according to a second embodiment of the invention.

FIG. 7 is an exploded perspective view of a seesaw type switch mechanism according to a second embodiment of the invention. In the first embodiment, the operating member 21 and the return member 23 have been assembled into the recess 22 through the open top thereof, but in the present embodiment they are assembled into the recess through a front opening 32b thereof. Specifically, a seesaw type switch mechanism 30 comprises an operating member 31 which undergoes a seesaw motion, a recess 32 in which the operating member 31 is disposed in a rockable manner, a pair of switch members 16, 17 which are acted upon by the operating member 31, and a return member 33 for returning the operating member 31 to its inoperative or original position. The switch mechanism of this embodiment differs from that of the first embodiment in respects of a support construction for the operating member 31 and the location of the return member 33. In other respects, the mechanism is constructed in substantially the same manner as in the first embodiment. Consequently, only the differences will now be described.

The operating member 31 has a pair of tabs 31a, 31b formed in its left- and right-hand halves which are exposed outside the housing. It is also integrally formed with a pair of protuberances 31c, 31d on its rear surface in general alignment with the tabs 31a, 31b for operating respective switches. A pair of ears 31e, 31f are integrally formed centrally on the rear surface along the both longitudinal edges, with the individual ears 31e, 31f being centrally formed with openings 31g, 31h which are adapted to receive a support pin 34.

The recess 32 is integrally molded in the lower housing 3, and is rectangular or box-shaped in configuration formed by an inner wall 32c, lateral sidewall 32d, 32e and a bottom wall 32f, with its top and front side being entirely open. A pair of lips 32g, 32h are centrally mounted on the inner surface of the inner wall 32c and are spaced apart in vertical alignment with each other. Toward the free end, the lips 32g, 32h are formed with openings 32i, 32j for receiving the support pin 34. A pair of notches 32m, 32n are formed in the inner wall on the opposite sides of the lips 32g, 33h to be aligned with the respective paths of movement of the protuberances 31c, 31d.

The return member 33 is in the form of a transversely elongate frame which is formed of an elastic foamed plastics material such as urethane foam. The outer surface of the return member 33 is centrally shaved in a chevron configuration, thus forming notches 33a, 33b against which the arcuate free end of the ears 31e, 31f abut.

When the described members are assembled into the housing (see FIG. 8), the return member 33 is initially fitted into the recess 22 through the front opening 32b, with its inner surface bearing against the inner surface of the inner wall 32c. In its central region, the lower surface of the top side of the return member 33 then bears against the upper surface of the upper lip 32g adjacent to the base end thereof while the upper surface of the bottom side of the return member 33 bears against the lower surface of the lower lip 32h adjacent to the base end thereof. Subsequently, the operating member 31 is placed through the front opening 32b into the recess 32 so that the ears 31e, 31f are vertically aligned with the lips 32g, 32h. Finally, the support pin 34 is passed through the individual openings 31g, 31h, formed in the ears 31e, 31f and though the openings 32i, 32j formed in the lips 32g, 32h.

Figure 9:
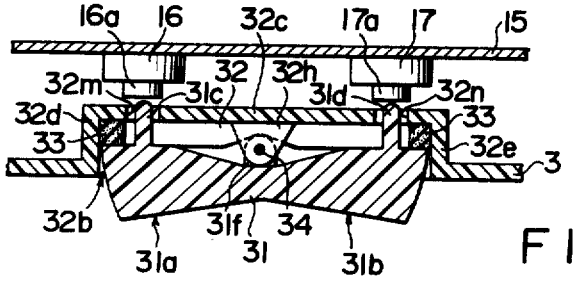
FIGS. 9 and 10 are cross sections of the seesaw type switch mechanism shown in FIG. 7, FIG. 10 illustrating an operative condition of the switch mechanism.

When the return member 33 and the operating member 31 are assembled into the recess 32 in the manner mentioned above, the operating member 31 is rockable about the support pin 34. As shown in FIG. 9, the inner surface of the opposite ends of the operating member bears against the front surface of the short sides of the return member 33 while protuberances 31c, 31d extend through the notches 32m, 32n. The tabs 31a, 31b of the operating member 31 are equally exposed through the front opening 32b of the recess 32 by projecting therethrough.

Subsequently, the upper housing 2 is brought into mating relationship with the lower housing 3 (see FIG. 7), whereby the closure plate 2aA of the upper housing 2 closes the open top 32a of the recess 32, preventing the ingress of any dust.

Figure 10:
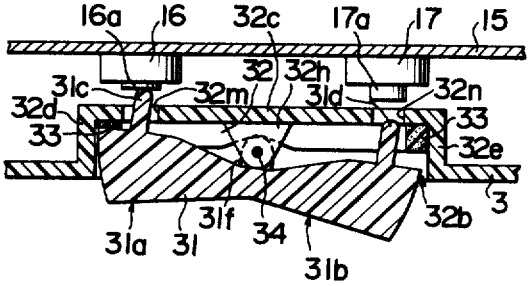

In operation, when the tab 31a of the operating member 31 is depressed, the member moves clockwise about the support pin 34, whereby, as viewed in FIG. 10, protuberance 31c operates the pushbutton 16a of the switch member 16, thus operating the associated electrical contact. As the operating member 31 moves clockwise in this manner, the rear surface of the left-hand end thereof compresses the left-hand short side of the return member 33 against its own resilience. In this manner, restoring resilience is stored by the return member 33. When the tab 31a is subsequently released, the restoring resilience of the short side of the return member 33 causes the operating member 31 to move counter-clockwise about the pin 34, thus returning it to the original position shown in FIG. 9.

Alternatively, when the tab 31b is depressed, the operating member 31 moves counter-clockwise about the support pin 34, with its right-hand protuberance 31d operating the switch member 17. The rear surface of the right-hand end of the operating member compresses the right-hand short side of the return member 33, thus storing resilience. Hence, when the tab 31b is released, the restoring resilience causes the operating member 31 to turn clockwise about the support pin 34, thus returning it to the original position shown in FIG. 9.

Thus, with the switch mechanism 30 according to the second embodiment, the return member 33 and the operating member 31 can be assembled into the recess 32 through the front opening 32b, greatly facilitating the assembly of the switch mechanism.

Figure 8:
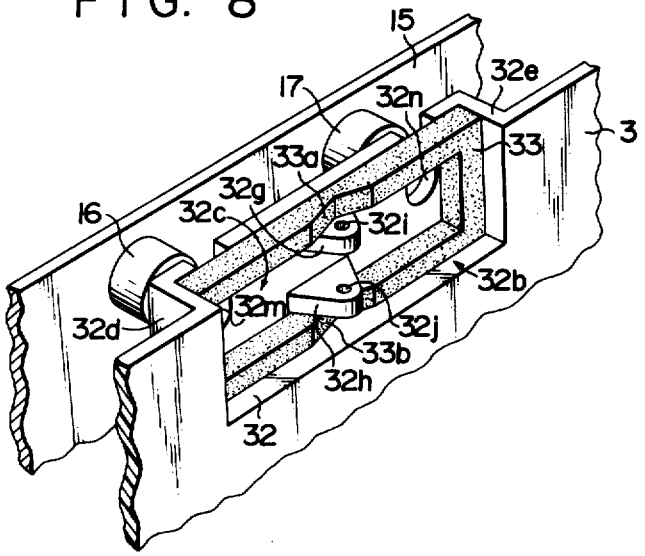
FIG. 8 is a perspective view illustrating the disposition of a return member in the seesaw type switch mechanism shown in FIG. 7.
Figure 11:
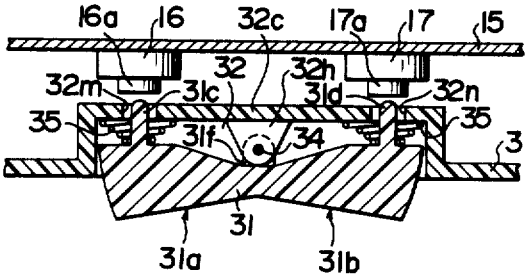
FIG. 11 is a cross section showing another form of return member which may be used in the seesaw type switch mechanism shown in FIG. 7.

The return spring 33 used in the second embodiment shown in FIGS. 7 to 9 may be replaced by a pair of spiral and helical springs 35 shown in FIG. 11. The pair of springs 35 are disposed on the individual protuberances 31c, 31d, and act between the inner surface of the inner wall 32c and the rear surface of the operating member 31.

Figure 12:
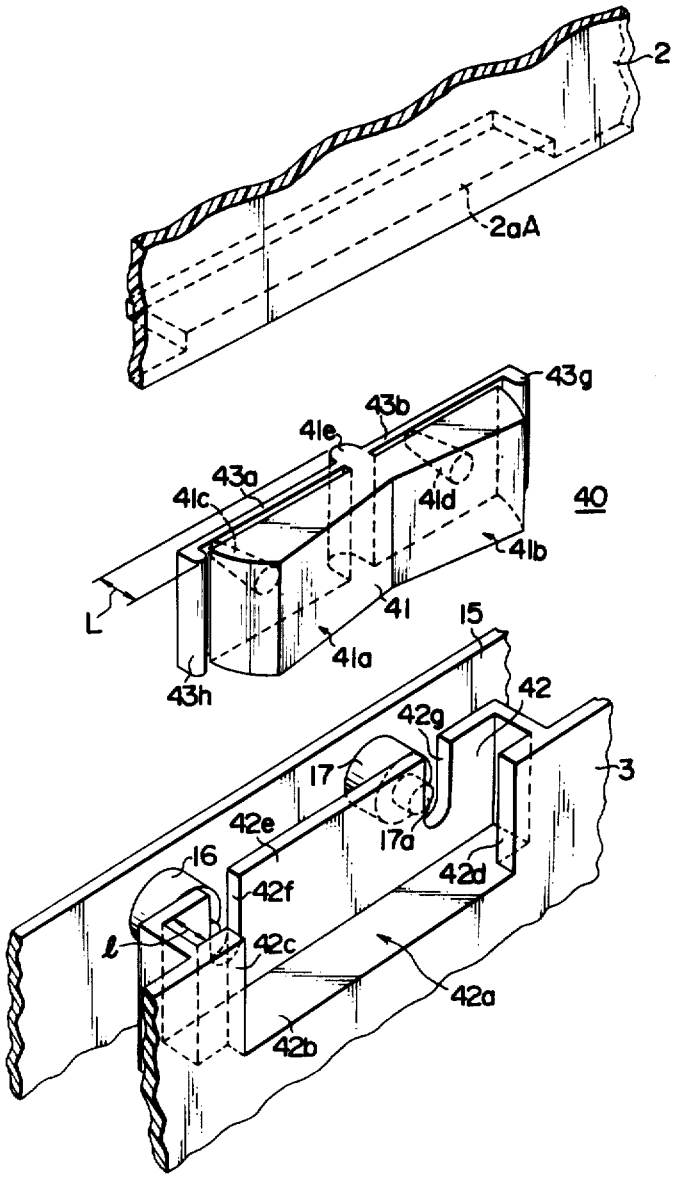
FIG. 12 is an exploded perspective view of a seesaw type switch mechanism according to a third embodiment of the invention.

FIG. 12 is an exploded perspective view of a seesaw type switch mechanism according to third embodiment of the invention. A switch mechanism 40 according to this embodiment dispenses with the return member 23 used in the switch mechanism 20, but instead has return members integrally molded with the operating member. The switch mechanism 40 essentially comprises an operating member 41 which undergoes a seesaw motion and which is integrally formed with return members 43a, 43b, a recess 42 in which the operating member 41 is rockably disposed, and a pair of switch members 16, 17 which are acted upon by the operating member 41.

The recess 42 is quite similar to the recess 22 used in the first embodiment except that the bottom wall 42b of the recess 42 is not formed with a transverse groove in which the return member engages. It is in the form of a transverse elongate rectangular box configuration contiguous with the lower housing 3 and having an open top and a front opening 42a. A pair of short sidewalls 42c, 42d define the both lateral ends of the front opening 42a and lie in the same plane as the sidewall of the lower housing 3. It includes an inner wall 42e in which a pair of notches 42f, 42g are formed which are open at their top end.

As in the first embodiment, the switch members 16, 17 are disposed behind the inner wall 42e in alignment with the notches 42f, 42g and are mounted on the substrate 15.

The operating member 41 is formed with tabs 41a, 41b in its left- and right-hand halves to be exposed externally of the housing. On its rear surface, the operating member is integrally formed with protuberances 41c, 41d in alignment with the tabs 41a, 41b while another protuberance 41e is centrally formed on the rear surface as an integral, longitudinal rib for defining a fulcrum for the rocking motion. The pair of return members 43a, 43b are integral with and extend in opposite directions laterally from the upper and lower ends of the rib 41e. It will be noted that these return members are in the form of elongate arms.

Figure 13:
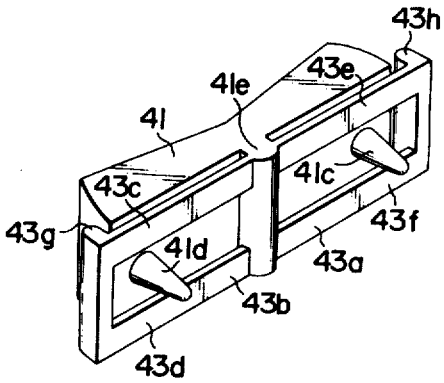
FIG. 13 is a perspective view of the operating member shown in FIG. 12, taken alone, and as viewed from the upper rear side thereof.

As shown in FIG. 13, each of the return members 43a, 43b comprises a pair of left-hand arms 43c, 43d or a pair of right-hand arms 43e, 43f, formed by thin sheets extending beyond the length of the rear surface of the operating member 41, and a rib 43g extending across the free ends of the left-hand arms 43c, 43d to connect them together and projecting in a direction toward the front surface of the operating member 41 or a rib 43h extending across the free ends of the right-hand arms 43e, 43f to connect them together and projecting in a direction toward the front surface of the operating member 41.

These return members 43a, 43b are integrally molded from a plastic material together with the operating member 41. The thin sheets which form the arms of the return members impart a resilience to these arms. It is to be noted that the ribs 43g, 43h have a height of projection such that a distance L measured between the tip of the ribs 43g, 43h and the tip of the protuberance 41e on the operating member 41 is slightly greater than a distance l, as measured between the inner surface of the inner wall 42 and the inner surface of the sidewalls 42c, 42d, as viewed in FIG. 12. When the operating member 41 is received in the recess 42, the ribs 43g, 43h have their tip ends aubtting against the inner surface of sidewalls 42c, 42d.

As in the second embodiment shown in FIG. 7, the upper housing 2 is integrally molded with a flat closure plate 2aA to close the open top of the recess 42 of the present embodiment.

Figure 14:
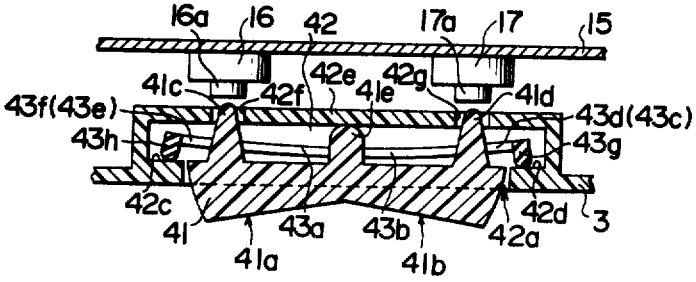
FIGS. 14 and 15 are cross sections of the seesaw type switch mechanism shown in FIG. 12, FIG. 15 illustrating an operative condition thereof.

When the described members are to be assembled into the housing 3, the operating member 41 is placed into the recess 42 through the open top thereof to cause the protuberance 41e to abut against the inner surface of the inner wall 42e and to cause the ribs 43g, 43h to abut against the inner surface of the sidewalls 42c, 42d, respectively. The operating member 41 is then rockably disposed in the recess 42 as indicated in FIG. 14, with the protuberances 41c, 41d extending through the notches 42f, 42g to be located opposite to the switch members 16, 17, respectively, and with the tabs 41a, 41b being externally exposed through the front opening 42a of the recess 42 by projecting outward by an equal amount.

Because the described distance L (see FIG. 12) between the tip ends of the ribs 43g, 43h and the tip end of the protuberance 41e is greater than the distance l between the inner surfaces of the inner wall and the sidewalls of the recess 42, the arms 43c, 43d, 43e, 43f are inwardly flexed, allowing a balanced positioning of the operating member within the recess 42. Subsequently, the upper housing 2 shown in FIG. 12 is brought into mating relationship with the lower housing 3, allowing the open top of the recess 42 to be closed by the closure plate 2aA.

Figure 15:
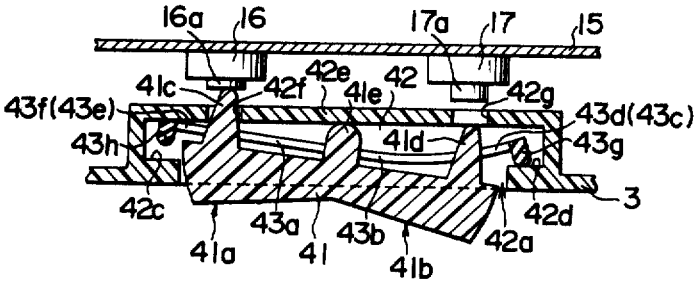

In operation, when the left-hand tab 41a is depressed (see FIG. 15), the operating member 41 moves angularly about a fulcrum defined by the abutment of the protuberance 41 against the inner surface of the inner wall 42e, with the left-hand protuberance 41c operating the pushbutton 16a of the switch member 16 to operate its electrical contact. As the operating member 41 moves clockwise, the left-hand rib 43h moves away from the sidewall 42c, but as a result of the clockwise turning of the protuberance 41e which defines the fulcrum for the rocking motion, the right-hand arms 43d, 43c flex to a greater extent, with the rib 43g abutting against the sidewall 42d with a greater force, thus allowing a restoring force to be stored in the return member 43b. When the tab 41a is then released, the returning force of the return member 43b causes the operating member 41 to move counter-clockwise about the fulcrum, thus returning it to the original position shown in FIG. 14.

Alternatively, when the right-hand tab 41b is depressed, the operating member 41 moves counter-clockwise about the fulcrum, with the right-hand protuberance 41d operating the switch member 17 and causing the return member 43a to store a restoring resilience. When the tab 41b is then released, the restoring resilience of the return member 43a causes the operating member 41 to move clockwise about the fulcrum, thus returning it to the original position shown in FIG. 14.

In the switch mechanism 40 mentioned above, the return members 43a, 43b are formed integrally with the operating member 41, thus dispensing with the use of separate return members to reduce the number of parts required, which contributes to achieving a reduction in the manufacturing cost.

Figure 16:
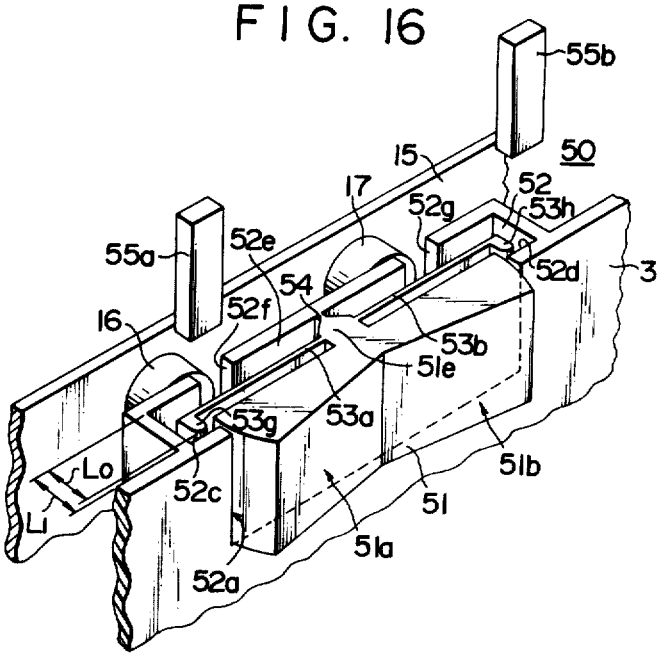
FIG. 16 is a perspective view of a seesaw type switch mechanism according to a fourth embodiment of the invention.
Figure 17:
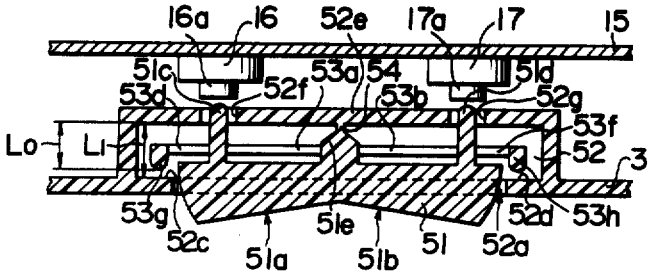
FIG. 17 is a cross section of the seesaw type switch mechanism shown in FIG. 16.
Figure 18:
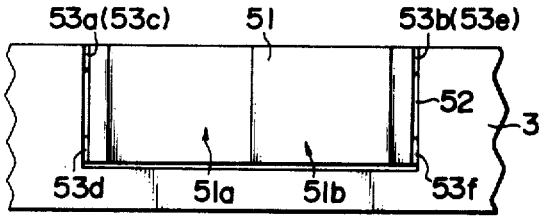
FIG. 18 is a front view of the seesaw type switch mechanism shown in FIGS. 16 and 17.
Figure 19:
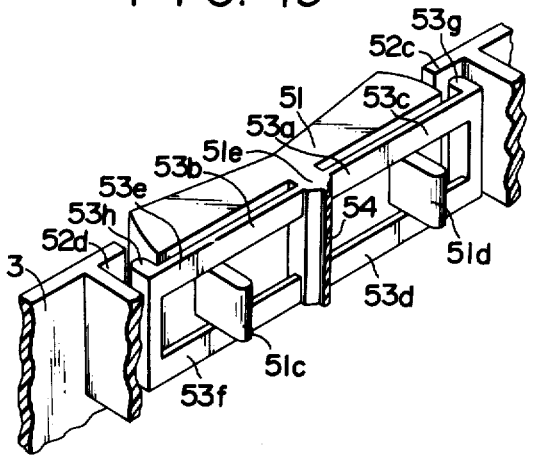
FIG. 19 is a perspective view of the operating member and return member used in the seesaw type switch mechanism shown in FIGS. 16 to 18, as viewed from the rear side thereof.

FIG. 16 is a perspective view of a seesaw type switch mechanism according to a fourth embodiment of the invention. A switch mechanism 50 according to the fourth embodiment fastens or connects the protuberance which defines the fulcrum for the rocking motion, as constructed in the manner of the third embodiment, to the inner wall of the recess so that the operating member having integral return members may be molded simultaneously as the recess is formed is by plastic molding in contiguous relationship with the lower housing 3. Thus parts of the switch mechanism 50 shown is substantially similar to those of the switch mechanism 40.

Specifically, the recess 52 is formed contiguous with the lower housing 3 and has a transversely elongate, rectangular box configuration which is open in its top and front side. A pair of sidewalls 52c, 52d extend to define a front opening 52a, and the recess is partly defined by an inner wall 52e which are formed with open-top notches 52f, 52g. Switch members 16, 17 are mounted on the substrate 15 which is disposed behind the inner wall 52e in alignment with the notches 52f, 52g, respectively.

The operating member 51 is formed with tabs 51a, 51b in its left- and right-hand halves which are exposed externally of the housing 3, as previously illustrated in connection with FIGS. 16 to 19. A pair of protuberances 51c, 51d in the form of ribs are integrally formed on the rear surface of the operating member in alignment with the tabs 51a, 51b, respectively, for operating switches. A rib 51e is integrally formed centrally on the rear surface of the operating member for defining a fulcrum for rocking motion thereof. Return members 53a, 53b formed by resilient arms extend from the opposite sides of the rib 51e in different directions and along the rear surface of the operating member. Specifically, the return member 53a comprises a pair of left-hand upper and lower arms 53c, 53d and a rib 53g extending across and connecting the free ends of these arms together while the return member 53b comprises a pair of right-hand upper and lower arms 53e, 53f and a rib 53h extending across and connecting together the free ends of these arms.

The operating member 51 having the return members 53a, 53b formed integrally therewith is molded from a plastic material at the same time as the recess 52 is molded. Specifically, both the operating member 51 and the recess 52 are formed in one plastic molding operation, by connecting the free end of the protuberance 51e with a central portion of the inner wall 52e of the recess 52 through a longitudinally extending thin piece 54. When so molded, the protuberances 51c, 51d formed on the rear surface of the operating member 51 extend through notches 52f, 52g formed in the inner wall 52e of the recess 52 and the ribs 53g, 53h are located opposing to the sidewalls 52c, 52d, respectively.

The ribs 53g, 53h are located opposing to the sidewalls 52c, 52d, respectively, because the molding operation is incapable of forming the ribs 53g, 53h in a manner to be movable toward or away from the inner surface of the sidewalls 52c, 52d. Hence, in the present embodiment, a pair of spacers 55a, 55b (see FIG. 16) are provided against which the tip end of the ribs 53g, 53h abuts. To permit the spacers 55a, 55b to be disposed, a distance $L_O$ between the inner surface of the inner wall 52e and the tip end of the ribs 53g, 53h is chosen to be less than a distance $L_1$ between the inner surface of the inner wall 52e and the inner surface of the sidewalls 52c, 52d, permitting the spacers 55a, 55b to be disposed intermediate the inner surface of the sidewalls 52c, 52d and the tip end of the ribs 53g, 53h.

As shown in FIG. 16, the spacers 55a, 55b are each in the form of a longitudinally elongate, rectangular pillar which is formed of a hard plastic material, for example. They have a thickness which is on the order of twice the distance between the inner surface of the sidewalls 52c, 52d and the tip end of the ribs 53g, 53h.

Figure 20:
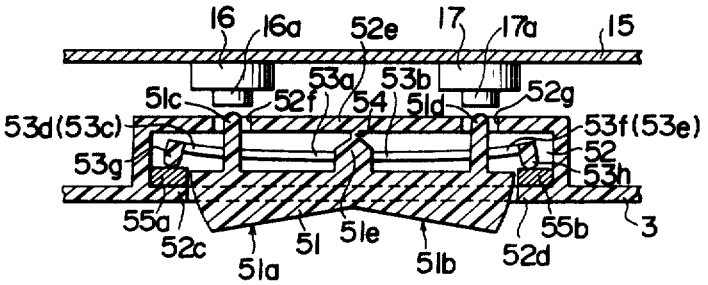
FIGS. 20 and 21 are cross sections of the seesaw type switch mechanism shown in FIGS. 16 to 19, FIG. 21 illustrating an operative condition thereof.

When the spacers 55a, 55b are located in the space defined between the inner surface of the sidewalls 52c, 52*d* and the tip end of the ribs 53*g*, 53*h* and are secured in position, the ribs 53*g*, 53*h* are displaced toward the inner wall 52*e* as a result of the abutment of their free end against the spacers 55*a*, 55*b*, and the arms 53*c*, 53*d*, 53*e*, 53*f* are flexed in the inward direction, as indicated in FIG. 20. After the spacers 55*a*, 55*b* are assembled in the manner mentioned above, the upper housing is brought into mating relarionship with the lower housing 3 to close the recess 52 by a flat closure plate which is formed on the upper housing, thereby completing the assembly of the switch mechanism 50.

Figure 21:
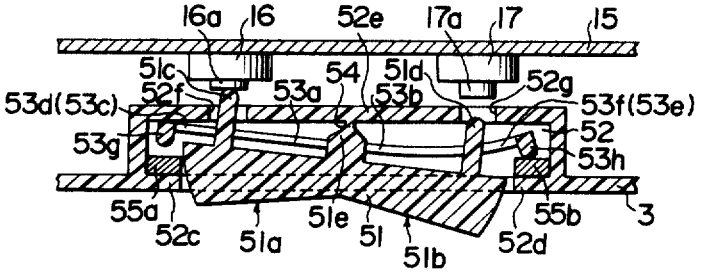

In operation, when the left-hand tab 51*a* is depressed, the operating member moves clockwise about a fulcrum which is defined by the thin piece 54 connecting the protuberance 51*e* with the inner wall 52*e*, as indicated in FIG. 21, with the left-hand protuberance 51*c* operating the pushbutton 16*a* of the switch member 16 to operate the electrical contact of the latter. As the operating member 51 moves clockwise, the left-hand rib 53*g* moves away from the spacer 55*a*, but as a result of the clockwise movement of the protuberance 51*e*, the right-hand arms 53*e*, 53*f* flex to a greater extent to increase the force with which the rib 53*h* abuts against the spacer 55*b*, thus allowing the return member 53*b* to store a restoring force therein. When the tab 51*a* is released, the restoring resilience of the return member 53*b* permits the operating member 51 to move counter-clockwise about the fulcrum, thus returning it to the original position shown in FIG. 20.

Alternatively when the right-hand tab 51*b* is depressed, the operating member 51 moves counter-clockwise about the fulcrum defined by the thin piece 54, with the right-hand protuberance 51*b* pressing against the pushbutton 17*a* of the switch member 17 to operate the associated switch. Simultaneously, the right-hand rib 53*h* moves away from the spacer 55*b*, causing a restoring resilience to be stored in the left-hand return member 53*a*. When the tab 51*b* is released, the restoring resilience of the return member 53*a* permits the operating member 51 to be returned to its original position.

In the switch mechanism 50, the operating member 51 having the return members 53*a*, 53*b* integrally formed therewith is molded simultaneously as the recess 52 is molded and is rockably disposed in the latter. Accordingly, a cumbersome assembly operation to dispose it in the recess can be eliminated.

Figure 22:
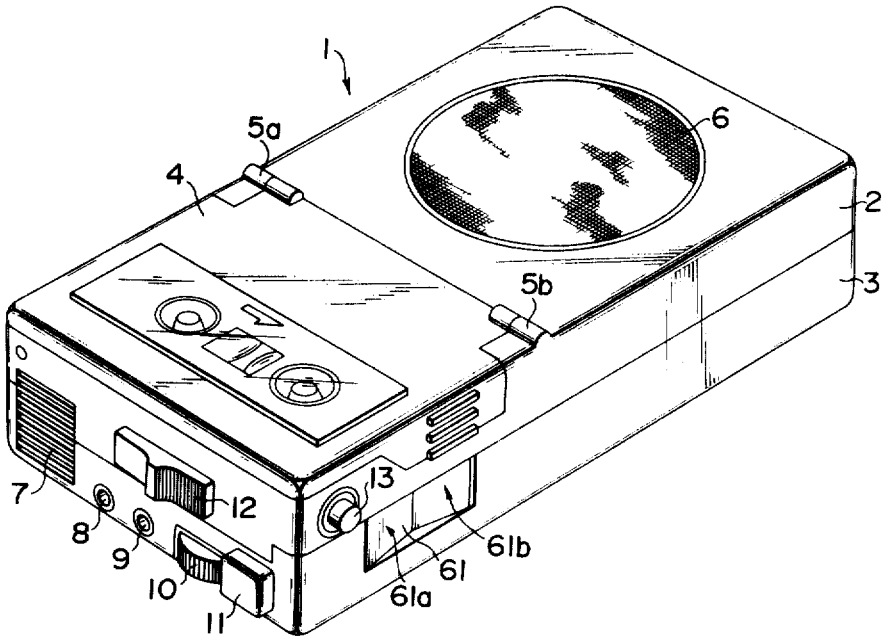
FIG. 22 is a perspective view of a miniature size tape recorder to which the switch mechanism of the invention is applied.

FIG. 22 shows a miniature tape recorder 1 in which is assembled a switch mechanism according to the invention which is constructed so that an operating member 61 does not project out of the housing during the operation of the mechanism. It is to be understood that the tape recorder 1 is constructed in a manner similar to the tape recorder shown in FIG. 1.

Figure 23:
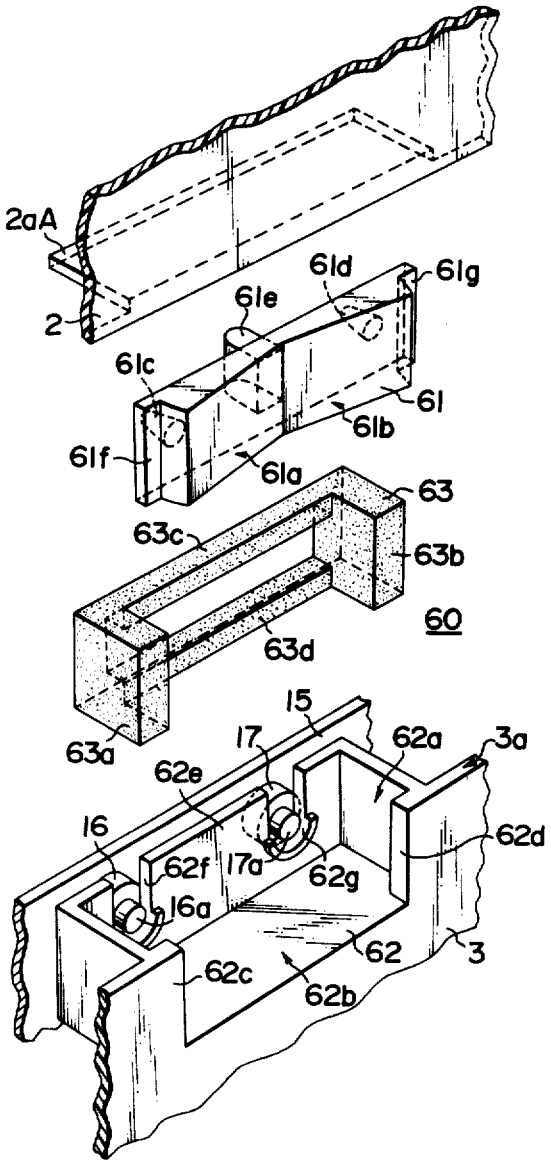
FIG. 23 is an exploded perspective view of a switch mechanism according to a fifth embodiment of the invention.

FIG. 23 is an exploded perspective view of a switch mechanism 60 according to a fifth embodiment of the invention which is assembled into the tape recorder 1. The switch mechanism 60 essentially comprises an operating member 61 which undergoes a rocking motion, a recess 62 in which the operating member 61 is rockably disposed, a pair of switch members 16, 17 which are acted upon by the operating member 61 as it rocks, and a return member 63 for returning the operating member 61 to its original position.

The operating member 61 is a rockable member formed of an electrical insulating material such as a plastic material and having a relatively thin thickness and presenting a transverse elongate rectangular configuration. Its outer surface is provided with a pair of tabs 61*a*, 61*b*, defined by inclined surfaces extending toward a joining line located at the center of the member. A pair of protuberances 61*c*, 61*d* are integrally formed on the rear surface of the operating member in alignment with the individual tabs 61*a*, 61*b*, respectively, for operating the associated switches 16, 17. A projection 61*e* in the form of a longitudinally extending rib is integrally formed on the rear surface at the center thereof and serves to prevent translational movement of the member 61. The outer edges of the tabs 61*a*, 61*b*, of the short sides of the operating member 61, are integrally formed with rims 61*f*, 61*g* extending outwardly therefrom and defining a fulcrum for the rocking motion of the operating member. As the operating member 61 is angularly driven, one of the rims 61*f*, 61*g* abuts against the sidewall adjoining to the recess 62 to define the fulcrum for the rocking motion of the operating member 61 while the other compresses the return member 63, thus allowing a restoring resilience to be stored therein.

As before, the recess 62 is in the form of a transversely elongate box contiguous with the lower housing 3 and having a top end which is flush with a boundary surface 3*a* between the upper and lower housings 2, 3, and has a suficient space to receive the operating member 61 in a rockable manner therein. As will be noted, the recess has an open top 62*a* and a front opening 62*b* which is laterally defined by sidewalls 62*c*, 62*d* formed by short extensions from the sidewall of the lower housing. The recess 62 has its inner end defined by an inner wall 62*e* in which notches 62*f*, 62*g* having open top ends are formed so as to be located on paths of movement of protuberances 61*c*, 61*d* formed on the operating member 61.

A substrate 15 on which various parts are mounted is fixedly arranged behind the inner wall 62*e*, and fixedly carries the switch members 16, 17 at locations corresponding to the notches 62*f*, 62*g*, respectively. The switch members 16, 17 are formed by pushbutton switches and include pushbuttons 16*a*, 17*a* which are disposed in the notches 62*f*, 62*g*, respectively.

The return member 63 is formed of an elastic foamed plastic material such as urethane foam which is shaped as a rectangular pillar. The return member comprises a left-hand member 63*a* and a right-hand member 63*b* having their outer surfaces abutting against the inner surface of the rims 61*f*, 61*g* and having their inner surfaces abutting against the inner surface of the inner wall 62*e*. The members 63*a*, 63*b* are connected together by a pair of connection members 63*c*, 63*d* which extend across the opposing surfaces thereof at a location adjacent to the inner surfaces thereof.

Figure 24:
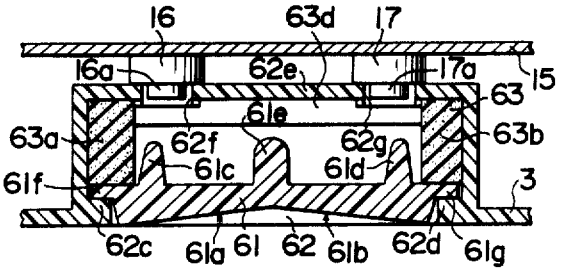
FIGS. 24 and 25 are cross sections of the switch mechanism shown in FIG. 23, FIG. 25 illustrating an operative condition thereof.
Figure 25:
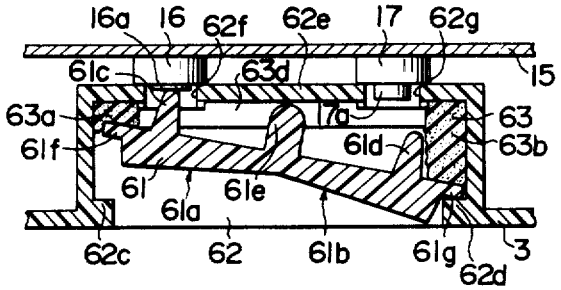
Figure 26:
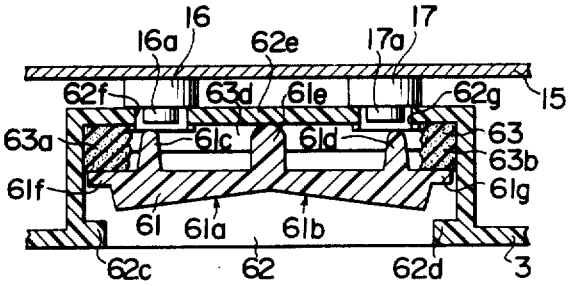
FIG. 26 is a cross section ilustrating a balanced movement of the operating member in the switch mechanism shown in FIGS. 23 to 25.

The switch mechanism 60 is assembled by initially disposing the operating member 61 into the recess 62 through the open top 62*a*. After the front surfaces of the rims 61*f*, 61*g* are disposed in abutment against the inner surface of the sidewalls 62*c*, 62*d*, the return member 63 is placed into the recess 62 through the top opening 62*a*, and the front surface of the return members 63*a*, 63*b* is disposed in abutment against the rear or inner surface of the rims 61*f*, 61*g* while the rear surface of each of the return members 63*a*, 63*b* is disposed in abutment against the inner surface of the inner wall 62*e*, thus completing the assembly as indicated in FIG. 24.

After the members 61, 63 are received in the recess 62, the upper housing 2 is brought into mating relationship with the lower housing 3, with the recess 62 being closed by a closure plate 2*a*A formed on the upper housing 2 to prevent the ingress of any dust.

In operation, when the left-hand tab 61*a* is depressed, the operating member 61 moves clockwise about a fulcrum which is defined by the abutment of the right-hand rim 61*g* against the inner surface of the sidewall 62*d*, with the left-hand protuberance 61*c* pressed against the pushbutton 16*a* to operate the associated switch 16. Simultaneously, the left-hand rim 61*g* compresses left-hand member 63*a*, thus allowing a restoring resilience to be stored therein. When the tab 61*a* is released, the restoring resilience of the member 63*a* causes the rim 61*f* to be moved back, driving the operating member 61 to move counter-clockwise about the fulcrum to return it to its original position shown in FIG. 24.

Alternatively when the right-hand tab 61*b* is depressed, the operating member 61 is moved counter-clockwise about a fulcrum defined by the abutment of the left-hand rim 61*f* against the inner surface of the sidewall 62*c*, with the right-hand protuberance 61*d* pressing against the pushbutton 17*a* of the switch member 17 to operate the latter. Also, the right-hand rim 61*g* compresses the right-hand member 63*b* to store a restoring resilience therein. When the tab 61*b* is released, the restoring resilience of the member 63*b* causes the operating member 61 to move clockwise about fulcrum to return it to its original position.

In the switch mechanism of this embodiment, the operating member 61 is angularly driven within the recess 62 about a fulcrum which is defined by the rims located at the opposite lateral ends thereof. As a result, the operating member 61 does not project out of the housing, avoiding any likelihood that such projection may degrade the appearance of an electrical instrument in which the switch mechanism is assembled.

In the switch mechanism 60, the operating member 61 disposed within the recess 62 may be spaced from the inner wall 62*e* thereof and the central region of the operating member 61 may be depressed. When the central region is depressed into the recess 62, the operating member 61 moves inward toward the inner wall 62*e* while maintaining a balanced position. The protuberances 61*c*, 61*d* tend to operate the switch members 16, 17, respectively. However, in the switch mechanism of the present embodiment, prior to the abutment of the protuberances 61*c*, 61*d* against the pushbuttons 16*a*, 17*a* of the switch members 16, 17, the protuberance 61*e* formed centrally on the rear surface of the operating member 61 abuts against the inner wall 62*e*, thus preventing a balanced or translational movement of the operating member 61. Thus, the depression of the central region of the operating member 61 cannot operate either switch member 16 or 17.

Figure 27:
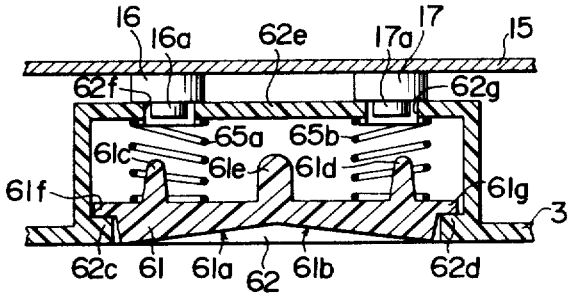
FIG. 27 is a cross section showing another form of return member which may be used in the switch mechanism of FIGS. 23 to 26.

The return members 63*a*, 63*b* shown in FIGS. 23 to 26 may be replaced by a pair of coiled springs 65*a*, 65*b* as illustrated in FIG. 27. In this instance, the pair of springs 65*a*, 65*b* are disposed on the protuberances 61*c*, 61*d*, respectively, formed on the operating member 61, and act between the inner surface of the inner wall 62*e* and the rear surface of the operating member 61.

What is claimed is:

1. A seesaw type switch mechanism comprising:

an operating member rockably disposed in a recess and having a pair of tabs formed on its outer surface in its left- and right-hand halves for causing an angular movement of the operating member in opposing directions, the operating member carrying spaced apart protuberances on the rear surface thereof, each being in alignment with one of the respective tabs for operating an associated switch;

switch members disposed on paths of movement of the protuberances for cooperation therewith, each of the switch membes being adapted to perform a switching operation as it is acted upon by one of the protuberances when the operating member is angularly driven;

the base of said recess forming a stationary wall separating said switch members from said operating member; and resilient return means positioned in said recess and being remote from said switch member and said protuberances and compressible by said operating member for returning the operating member to its original position where said stationary wall keeps the switch members clear from either protuberance and said return means after the force for angularly driving the operating member and compressing said return means is removed.

2. A seesaw type switch mechanism comprising an operating member having a pair of tabs formed on its outer surface in its left- and right-hand halves for causing an angular movement of the operating member in different directions, the operating member carrying protuberances on its rear surface in alignment with the respective tabs and also carrying a protuberance centrally on the rear surface, which defines a fulcrum for the angular movement of the operating member;

a recess in which the operating member is rockably disposed, the recess including a stationary inner wall located opposite to the rear surface of the operating member, a pair of notches being formed in the inner wall, and the protuberances entending into the respective notches;

a pair of switch members disposed in opposing relationship with the protuberances on the operating member, so that as the operating member is angularly driven, only one of the switch members is selectively operated by one of the protuberances which extends through a selected one of the notches;

and a return member in said recess and removed from said switch members for returning the operating member to its original position after the force which has angularly driven the operating member is removed.

3. A seesaw type switch mechanism according to claim 2 in which the operating member is rectangular in configuration and is formed of an electrical insulating material and includes a protuberance, part of which defines a fulcrum for rocking motion in the clockwise and the counter-clockwise direction.

4. A seesaw type switch mechanism according to claim 3 in which the operating member is formed with ribs which extend outwardly from the short sides thereof for pressing against the return member.

5. A seesaw type switch mechanism according to claim 3 in which the protuberance which defines the fulcrum for rocking motion has its free end disposed in abutment against the inner surface of the inner wall which defines the recess in which the operating member is received.

6. A seesaw type switch mechanism according to claim 3 in which the protuberance which defines the fulcrum for rocking motion has its outer end connected to the inner wall which defines the recess in which the operating member is received, through a thin piece, and is adapted to rock about the latter.

7. A seesaw type switch mechanism according to claim 3 in which the protuberance which defines the fulcrum for rocking motion is centrally fitted over a support pin which is secured to ribs on the inner wall of the recess in which the operating member is received, and is adapted to rock about the support pin.

8. A seesaw type switch mechanism comprising an operating member having a pair of tabs formed on its outer surface in its left- and right-hand halves for causing an angular movement of the operating member in different directions, the operating member carrying protuberances on its rear surface in alignment with the respective tabs and also carrying a protuberance centrally on the rear surface, which defines a fulcrum for the angular movement of the operating member;

a recess in which the operating member is rockably disposed, the recess including an inner wall located opposite to the rear surface of the operating member, a pair of notches being formed in the inner wall, and the protuberances extending into the respective notches;

a pair of switch members disposed in opposing relationship with the protuberances on the operating member so that as the operating member is angularly driven, one of the switch members being selectively operated by one of the protuberances, which extends through a selected one of the notches;

and a return member for returning the operating member to its original position it has been angularly driven, said recess having a rectangular box configuration having an open front side, and which is integrally formed in contiguous relationship with the outer wall of the casing of an electrical instrument in which the switch members are disposed, the inner wall of the recess being formed with a pair of notches through which the protuberances extend for operating the switch members.

9. A seesaw type switch mechanism according to claim 8 in which the box-shaped recess has its open front side defined by a pair of sidewalls which are contiguous with the outer wall of the casing of an electrical instrument in which the switch mechanism is incorporated.

10. A seesaw type switch mechanism according to claim 9 in which return members are disposed in abutment against the inner surface of the sidewalls for returning the operating member.

11. A seesaw type switch mechanism according to claim 9 in which return members are disposed on the inner surface of the sidewalls for returning the operating member.

12. A seesaw type switch mechanism according to claim 2 in which the switch members are in the form of a pair of pushbutton switches which are mounted on a substrate of an electrical instrument in which the switch mechanism is incorporated, the pair of switches being disposed in opposing relationship with the protuberances formed on the operating member.

13. A seesaw type switch mechanism according to claim 2 in which the return members are formed by an elastic material such as foamed plastics, coiled springs or the like.

14. A seesaw type switch mechanism comprising an operating member having a pair of tabs formed on its outer surface in its left- and right-hand halves for causing an angular movement of the operating member in different directions, the operating member carrying protuberances on its rear surface in alignment with the respective tabs and also carrying a protuberance centrally on the rear surface which defins a fulcrum for the angular movement of the operating member;

a recess in which the operating member is rockably disposed, the recess including an inner wall located opposite to the rear surface of the operating member, a pair of notches being formed in the inner wall, and the protuberances extending into the respective notches;

a pair of switch members disposed in opposing relationship with the protuberances on the operating member so that as the operating member is angularly driven, one of the switch members is selectively operated by one of the protuberances which extend through a selected one of the notches;

and a return member for returning the operating member to its original position after it has been angularly driven, the return members being disposed in abutment against the inner surface of sidewalls extending to define the front opening of the recess and are formed of an elastic material which is compressed against its own resilience by ledges formed on and extending along the opposite lateral edges of the operating members.

15. A seesaw type switch mechanism comprising an operating member having a pair of tabs formed on its outer surface in its left- and right-hand halves for causing an angular movement of the operating member in different directions, the operating member carrying protuberances on its rear surface in alignment with the respective tabs and also carrying a protuberance centrally on the rear surface which defines a fulcrum for the angular movement of the operating member;

a recess in which the operating member is rockably disposed, the recess including an inner wall located opposite to the rear surface of the operating member, a pair of notches being formed in the inner wall, and the protuberances extending into the respective notches;

a pair of switch members disposed in opposing relationship with the protuberances on the operating member so that as the operating member is angularly driven, one of the switch members is selectively operated by one of the protuberances which extends through a selected one of the notches;

and a return member for returning the operating member to its original position after it has been angularly driven, the return members being disposed in abutment against the inner surface of the inner wall of the recess and are formed of an elastic material which is compressed against its own resilience by the peripheral edge portion of the rear surface of the operating member.

16. A seesaw type switch mechanism comprising an operating member having a pair of tabs formed on its outer surfce in its left- and right-hand halves for causing an angular movement of the operating member in different directions, the operating member carrying protuberances on its rear surface in alignment with the respective tabs and also carrying a protuberance centrally on the rear surface which defines a fulcrum for the angular movement of the operating member;

a recess in which the operating member is rockably disposed, the recess including an inner wall located opposite to the rear surface of the operating member, a pair of notches being formed in the inner wall, and the protuberances extending into the respective notches;

a pair of switch members disposed in opposing relationship with the protuberances on the operating member so that as the operating member is angularly driven, one of the switch members is selectively operated by one of the protuberances which extends through a selected one of the notches;

and a return member for returning the operating member to its original position after it has been angularly driven, the return members being in the form of spiral coiled compression springs disposed on the protuberances provided on the operating member and acting between the inner surface of the inner wall of the recess and the rear surface of the operating member.

17. A seesaw type switch mechanism comprising an operating member having a pair of tabs formed on its outer surface in its left- and right-hand halves for causing an angular movement of the operating member in different directions, the operating member carrying protuberances on its rear surface in alignment with the respective tabs and also carrying a protuberance centrally on the rear surface which defines a fulcrum for the angular movement of the operating member;

a recess in which the operating member is rockably disposed, the recess including an inner wall located opposite to the rear surface of the operating member, a pair of notches being formed in the inner wall, and the protuberances extending into the respective notches;

a pair of switch members disposed in opposing relationship with the protuberancces on the operating member so that as the operating member is angularly driven, one of the switch members is selectively operated by one of the protuberances which extends through a selected one of the notches;

and a return member for returning the operating member to its original position after it has been angularly driven, the return members being formed by resilient arms extending oppositely lengthwise, along the rear surface of the operating member, from the protuberance which defines the fulcrum and having their free ends formed as ribs which are disposed in abutment against the inner surface of sidewalls extending to define the front opening of the recess.

18. A seesaw type switch mechanism comprising an operating member having a pair of tabs formed on its outer surface in its left- and right-hand halves for causing an angular movement of the operating member in different directions, the operating member carrying protuberances on its rear surface in alignment with the respective tabs and also carrying a protuberance centrally on the rear surface which defines a fulcrum for the angular movement of the operating member;

a recess in which the operating member is rockably disposed, the recess including an inner wall located opposite to the rear surface of the operating member, a pair of notches being formed in the inner wall, and the protuberances extending into the respective notches;

a pair of switch members disposed in opposing relationship with the protuberances on the operating member so that as the operating member is angularly driven, one of the switch members is selectively operated by one of the protuberances which extends through a selected one of the notches;

and a return member for returning the operating member to its original position after it has been angularly driven, each of the return members comprising a spacer disposed in abutment against the inner surface of one of the sidewalls extending to define the open front side of the recess, and a resilient arm extending oppositely lengthwise, along the rear surface of the operating member, from the protuberance formed thereon which defines the fulcrum for rocking motion and having its free end formed as a rib which resiliently bears against the spacer.

19. A seesaw type switch mechanism comprising an operating member including an outer surface, the left- and right-hand halves of which are formed with a pair of tabs for causing an angular movement of the operating member in different directions, the operating member also including a pair of ribs formed along and extending outwardly from the opposite lateral ends of the tabs for defining a fulcrum for rocking motion of the operating member, a pair of switch operating protuberances formed on the rear surface of the operating member in alignment with the respective tabs for operating switches, and another protuberance centrally formed on the rear surface of the operating member for preventing a translational movement of the operating member;

a recess in which the operating member is rockably disposed, the recess being partly defined by an inner wall separating the operating member from the switch members and located opposite to the centrally formed protuberance which prevents translational movement, and a pair of sidewalls against which the fulcrum ribs of the operating member are adapted to abut, the inner wall being formed with a pair of notches through which the switch operating protuberances of the operating member extend;

a pair of switch members disposed in opposing relationship with the switch operating protuberances and adapted to be selectively operated by an associated one of the switch operating protuberances as the operating member is angularly driven;

and return means for returning the operating member to its original position after the force which has angularly driven the operating member is removed.

20. A seesaw type switch mechanism according to claim 19 in which the operating member is rectangular in configuration and is formed of an electrical insulating material and is disposed for angular movement in the clockwise and the counter-clockwise direction about the fulcrum which is defined by the abutment of one of the ribs against one of the sidewalls, the tabs on the outer surface of the operating member being prevented from projecting outwardly from the recess during the angular movement thereof as well as when it remains inoperative, as a result of the sidewalls constraining the ribs.

21. A seesaw type switch mechanism according to claim 19 in which, as the operating member angularly moves about the fulcrum defined by one of the ribs, the other rib presses against the return means.

22. A seesaw type switch mechanism comprising an operating member including an outer surface, the left- and right-hand halves of which are formed with a pair of tabs for causing an angular movement of the operating member in different directions, the operating member also including a pair of ribs formed along and extending outwardly from the opposite lateral ends of the tabs for defining a fulcrum for rocking motion of the operating member, a pair of switch operating protuberances formed on the rear surface of the operating switches, and another protuberance centrally formed on the rear surface of the operating member for preventing a translational movement of the operating member;

a recess in which the operating member is rockably disposed, the recess being partly defined by an inner wall located opposite to the centrally formed protuberance which prevents translational movement, and a pair of sidewalls against which the fulcrum ribs of the operating member are adapted to abut, the inner wall being formed with a pair of notches through which the switch operating protuberances of the operating member extend;

a pair of switch members disposed in opposing relationship with the switch protuberances and adapted to be selectively operated by an associated one of the switch operating protuberances as the operating member is angularly driven;

and return means for returning the operating member to its original position after the force which has angularly driven the operating member is removed, the recess being in the form of a rectangular box having an open front side and which is integrally formed in contiguous relationship with an outer wall of the casing of an electrical instrument in which the switch members are disposed, the recess being partly defined by sidewalls which extend oppositely to define the open front side of the recess.

23. A seesaw type switch mechanism according to claim 19 in which the switch members are in the form of a pair of pushbutton switches mounted on a substrate of an electrical instrument and disposed in opposing relationship with the protuberances of the operating member.

24. A seesaw type switch mechanism according to claim 19 in which the return means is formed of an elastic material such as foamed plastics or coiled springs.

25. A seesaw type switch mechanism comprising an operating member including an outer surface, the left- and right-hand halves of which are formed with a pair of tabs for causing an angular movement of the operating member in different directions, the operating member also including a pair of ribs formed along and extending outwardly from the opposite lateral ends of the tabs for defining a fulcrum for rocking motion of the operating member, a pair of switch operating protubrances formed on the rear surface of the operating member in alignment with the respective tabs for operating switches, and another protuberance centrally formed on the rear surface of the operating member for preventing a translational movement of the operating member;

a recess in which the operating member is rockably disposed, the recess being partly defined by an inner wall located opposite to the centrally formed protuberance which prevents translational movement, and a pair of sidewalls against which the fulcrum ribs of the operating member are adapted to abut, the inner wall being formed with a pair of notches through which the switch operating protuberances of the operating member extend;

a pair of switch members disposed in opposing relationship with the switch operating protuberances and adapted to be selectively operated by an associated one of the switch operating protuberances as the operating member is angularly driven;

and return means for returning the operating member to its original position after the force which has angularly driven the operating member is removed, in which the return means comprises resilient members disposed and acting between the inner surface of the inner wall of the recess and the rear surface of the ribs on the operating member which defines the fulcrum for rocking motion thereof.

26. A seesaw type switch mechanism comprising an operating member including an outer surface, the left- and right-hand halves of which are formed with a pair of tabs for causing an angular movement of the operating member in different directions, the operating member also including a pair of ribs formed along and extending outwardly from the opposite lateral ends of the tabs for defining a fulcrum for rocking motion of the operating member, a pair of switch operating protuberances formed on the rear surface of the operating member in alignment with the respective tabs for operating switches, and another protuberance centrally formed on the rear surface of the operating member for preventing a translational movement of the operating member;

a recess in which the operating member is rockably disposed, the recess being partly defined by an inner wall located opposite to the centrally formed protuberance which prevents translational movement, and a pair of sidewalls against which the fulcrum ribs of the operating member are adapted to abut, the inner wall being formed with a pair of notches through which the switch operating protuberances of the operating member extend;

a pair of switch members disposed in opposing relationship with the switch operating protuberance and adapted to be selectively operated by an associated one of the switch operating protuberances as the operating member is angularly driven;

and return means for returning the operating member to its original after the force which has angularly driven the operating member is removed, in which the return means comprises coiled springs disposed on the protuberances on the operating member and resiliently acting between the inner surface of the rear operating member.

27. A seesaw type switch mechanism for selectively operating first and second switches arranged in stationary manner comprising:

an operating member rockably disposed in a recess and having a pair of tabs formed on its outer surface in its left- and right-hand halves for causing an angular movement of the operating member in different directions, the operating member having rigid rear surface portions in alignment with the respective tabs for operating an associated switch;

said first and second stationary switches having switch members respectively disposed in paths of movement of the rear surface portions for cooperation therewith, each of the switch members being adapted to perform a switching operation upon its associated switch, and to the exclusion of the other switch members, as it is acted upon by one of the surface portions when the operating member is angularly driven;

and compressible return means removed from rear surface portions and said switch members and engaged by said operating member for returning the operating member to its original position where the rear surface portions are displaced from the switch members.

28. A seesaw type switch mechanism according to claim 27 in which the switch members are in the form of a pair of pushbutton switches which are mounted on a substrate of an electrical instrument in which the switch mechanism is incorporated, the pair of switches being disposed in opposing relationship with the surface portions arranged on the rear surface of the operating member.

* * * * *